US007100253B2

(12) United States Patent
Fehrer

(10) Patent No.: US 7,100,253 B2
(45) Date of Patent: Sep. 5, 2006

(54) METHOD AND APPARATUS FOR PRODUCING MOP TRIMMINGS

(76) Inventor: Monika Fehrer, Wegscheider Strasse 15 A 4060, Leonding (AT)

( * ) Notice: Subject to any disclaimer, the term of this patent is extended or adjusted under 35 U.S.C. 154(b) by 242 days.

(21) Appl. No.: 09/879,393

(22) Filed: Jun. 12, 2001

(65) Prior Publication Data

US 2001/0049869 A1 Dec. 13, 2001

(30) Foreign Application Priority Data

Jun. 13, 2000 (AT) ..... A 1016/2000

(51) Int. Cl.
*D02J 11/00* (2006.01)

(52) U.S. Cl. ..... 28/247; 28/253; 28/112; 28/147

(58) Field of Classification Search ..... 28/107–115, 28/147, 247, 220, 103, 219, 253, 140, 141, 28/143, 145, 165, 170; 15/228, 229.1, 229.2; 57/351, 282, 283, 210, 211, 226, 227, 228, 57/243, 2, 206, 208
See application file for complete search history.

(56) References Cited

U.S. PATENT DOCUMENTS 1,479,906 A * 1/1924 Fisher ..... 15/153
3,115,658 A * 12/1963 Moss ..... 15/229.1
3,208,125 A 9/1965 Hall et al.
3,273,329 A * 9/1966 Scragg ..... 28/247
3,538,564 A * 11/1970 Skoler et al. ..... 28/107
3,568,234 A * 3/1971 Komatsu ..... 15/229.1
3,626,509 A * 12/1971 Rones ..... 15/144.2
3,783,479 A * 1/1974 Terry ..... 28/115
3,889,616 A * 6/1975 Passons et al. ..... 28/147
4,350,731 A * 9/1982 Siracusano ..... 57/230
4,674,271 A 6/1987 Bird
4,717,616 A * 1/1988 Harmon et al. ..... 15/229.1
4,750,234 A * 6/1988 Quearry et al. ..... 15/229.1
5,081,753 A 1/1992 Fink et al.
5,143,771 A * 9/1992 Fourezon ..... 28/107
5,538,327 A * 7/1996 Martorella et al. ..... 300/21
6,175,996 B1 * 1/2001 Gstrein et al. ..... 28/114
6,311,375 B1 * 11/2001 Patrick ..... 28/107
6,796,115 B1 * 9/2004 Patrick ..... 57/210

* cited by examiner

*Primary Examiner*—Amy B. Vanatta

(74) *Attorney, Agent, or Firm*—Collard & Roe, P.C.

(57) ABSTRACT

A method and an apparatus for producing mop trimmings from a twisted yarn (7) which is cut into pieces is described. In order to prevent any untwisting of the yarn pieces it is proposed that the twisted yarn (7) is subjected to a needling prior to cutting.

1 Claim, 3 Drawing Sheets

METHOD AND APPARATUS FOR PRODUCING MOP TRIMMINGS

FIELD OF THE INVENTION

The invention relates to a method for producing mop trimmings from a twisted yarn which is cut into pieces.

DESCRIPTION OF THE PRIOR ART

Yarns, in particular such of cotton, have proven their worth as trimmings for mops as long as the yarns do not untwist as a result of the use of the mop. The cleaning effect of such mop trimmings is impaired however with the increased untwisting of the yarns from the cut free end.

SUMMARY OF THE INVENTION

The invention is thus based on the object of providing a method for producing mop trimmings of the kind mentioned above in such a way that an untwisting of the yarn pieces used in the mop trimmings from their free ends can be excluded without impairing the cleaning effect.

The object is achieved in accordance with the invention in such a way that the twisted yarn is subjected to needling prior to cutting.

As a result of needling the twisted yarns, their twisting is effectively held, so that the likelihood of fringe formation by untwisting of the trimming elements as cut from the yarn is advantageously prevented, namely without any loss of cleaning effect, because the properties of the yarn pieces as demanded in connection with mop trimmings are not changed by the needling. Since the employed yarns can be needled continuously prior to cutting, the additional efforts needed can be kept relatively low since the needle-penetration density does not have to fulfill any high requirements.

Although it is known (U.S. Pat. No. 4,674,271 A, U.S. Pat. No. 5,081,753 A) to subject yarns to a treatment by needling, the yarns concern continuous yarn filaments which are to be broken by the needling in order to adapt such yarns in their properties to the usual yarns made of staple fibers. The known breakage of the continuous yarn filaments with the help of needles penetrating the yarn cannot provide any suggestion in the respect as to how mop trimmings should be treated in order to enable a permanent cleaning effect. The same applies to an other known needling method (U.S. Pat. No. 3,208,125 A) in which two filaments of continuous fibers are subjected to a needling process prior to their twisting in order to avoid any longitudinal displacement of the two filaments during the twisting. This needling prior to twisting does not prevent any untwisting of the twisted filaments.

In order to perform the needling of yarns which are used for mop trimmings according to the invention, it is possible to assume a conventional apparatus with a drivable needle board reciprocating in the direction of the needle penetration and a stitch base opposite of the needle board. It is merely necessary to ensure that the yarn cannot escape the penetrating needles. For this reason the stitch base is provided with at least one guide groove for the yarn which extends in the direction of yarn passage, with the needles of the needle board being arranged along the guide groove. With the yarn progress in the guide groove a lateral migration of the yarn to be needled is thus prevented in a simple way, so that the needling of the yarn transversally to the longitudinal direction of the yarn is ensured. The needles can be arranged along the longitudinal axis of the guide groove disposed in a line behind one another or mutually offset transversally to said axis in order to adapt the needling conditions to the respective conditions. In order to allow the needling of several yarns simultaneously, the stitching base can be provided with several parallel guide grooves for each yarn. The smooth run into and out of the guide grooves can be enforced in a simple way by means of guide eyes for the yarn.

It is understood that during the needling of the yarn it must be ensured that the material to be needled is stripped off from the needles which are moved in the drawing direction. This can be performed by stripping means which are disposed between the needle board and the stitching base on the side of the material which faces the needle board. Particularly advantageous guide conditions are obtained when the stitching base is not plane, but is provided in the known manner with an arrangement which is arched in a convex manner, because in this case a force component is obtained during the tensile load of the yarn to be needled which presses the yarn against the stitching base which renders the provision of a stripper superfluous.

BRIEF DESCRIPTION OF THE DRAWINGS

The method in accordance with the invention is now explained in closer detail by reference to the enclosed drawings, wherein.

DESCRIPTION OF THE PREFERRED EMBODIMENTS

Figure 1:
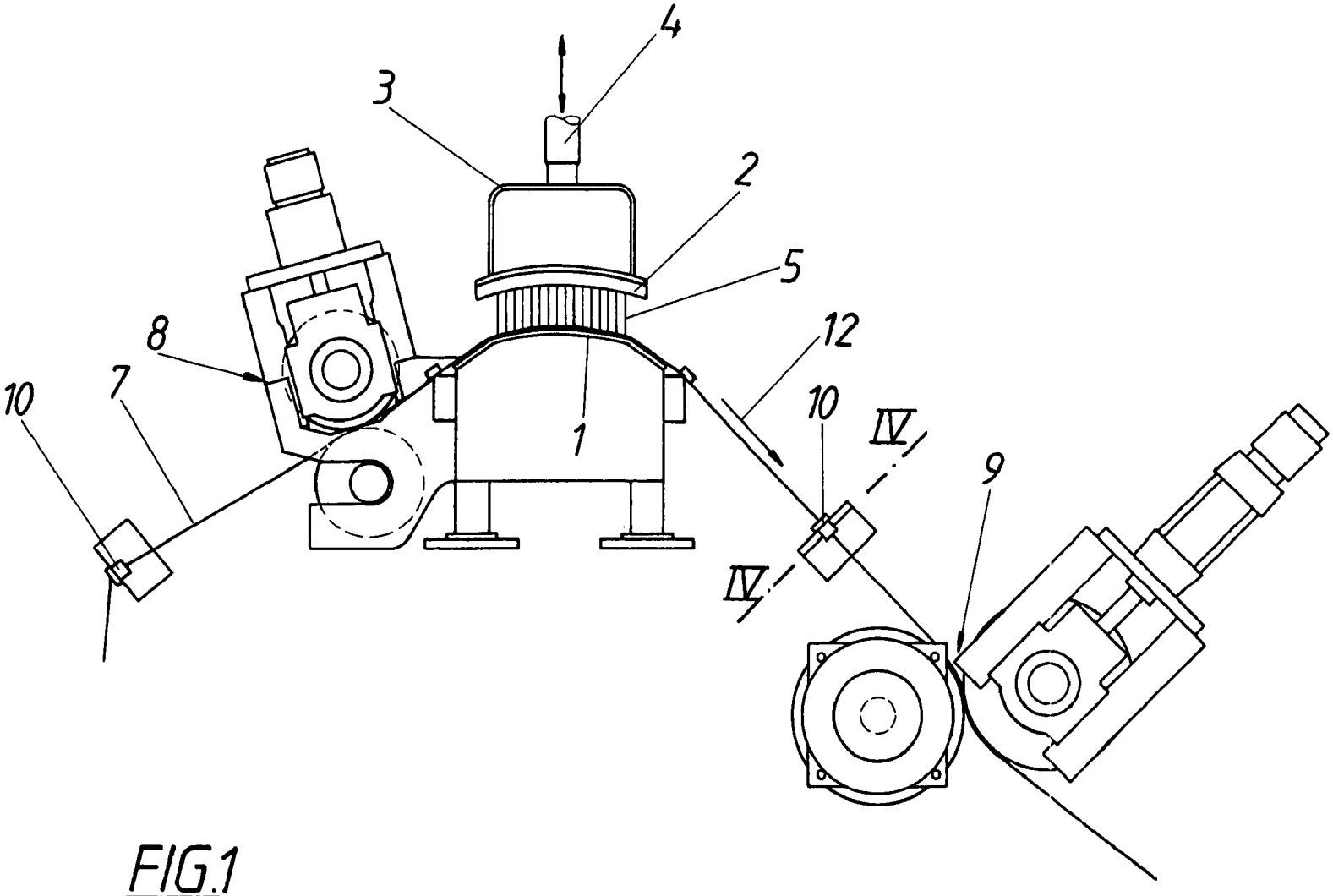
FIG. 1 shows an apparatus in accordance with the invention for needling a twisted yarn in a simplified side view.
Figure 2:
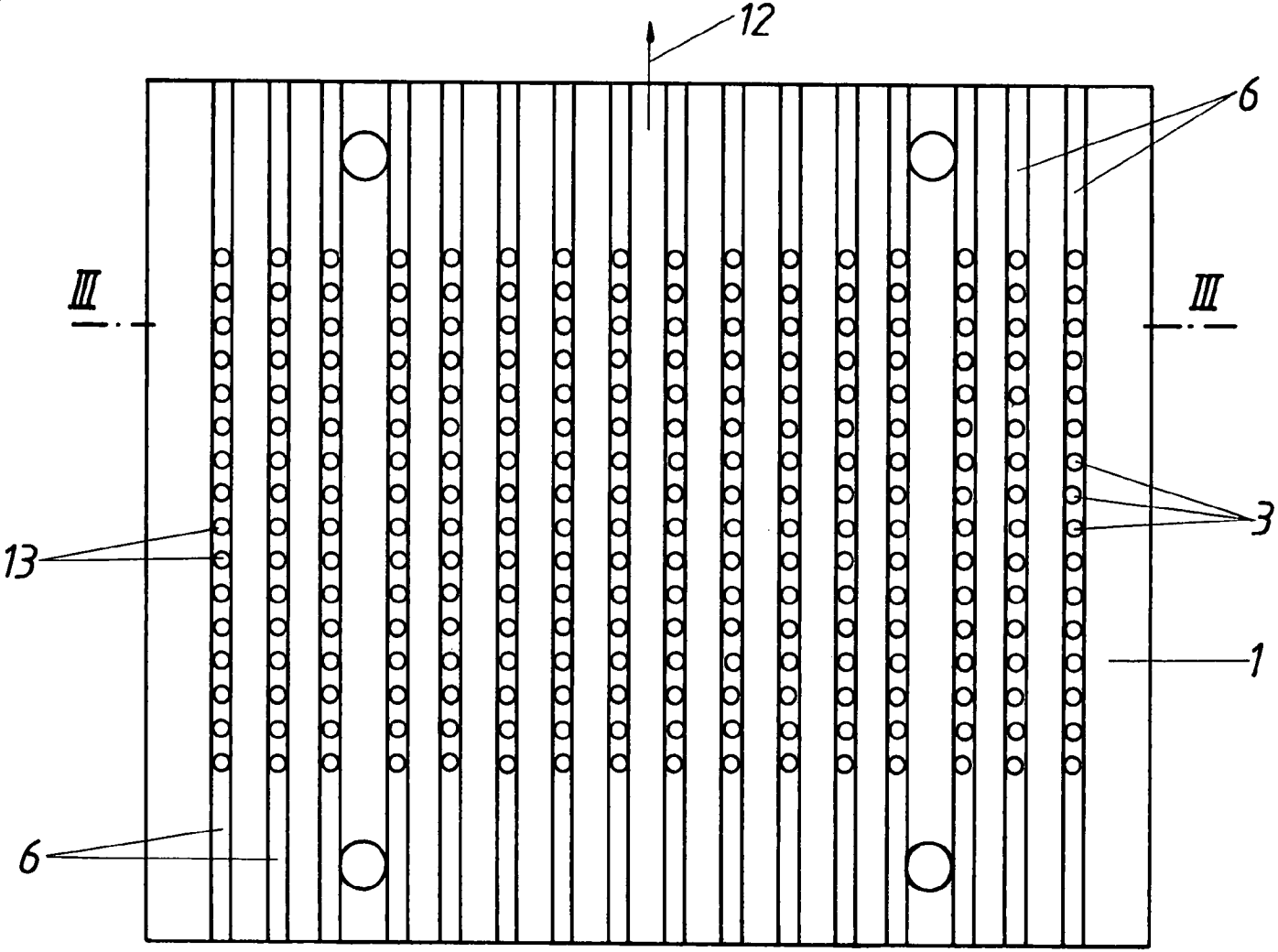
FIG. 2 shows a stitching base of the apparatus according to FIG. 1 in a top view on an enlarged scale.
Figure 3:
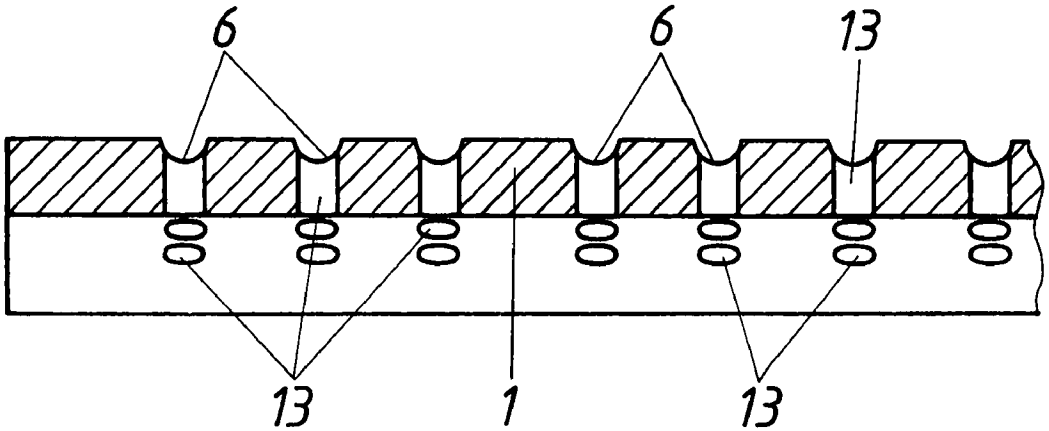
FIG. 3 shows a partial sectional view along line III—III of FIG. 2 on an enlarged scale.
Figure 4:
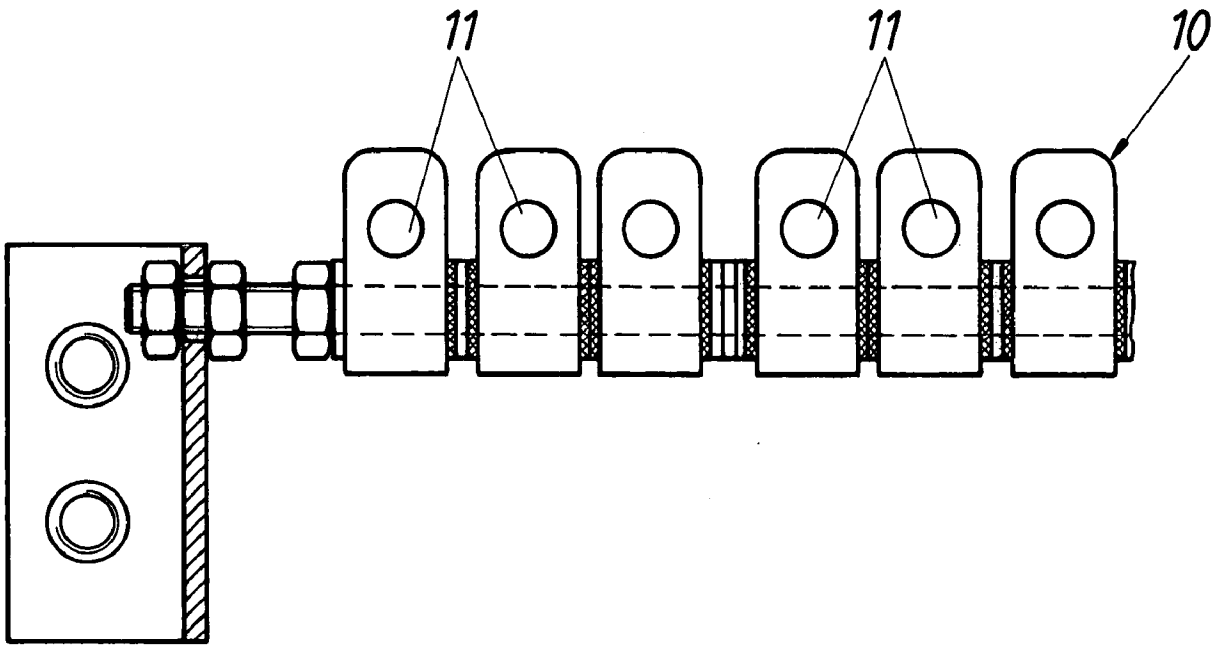
FIG. 4 shows a partial sectional view along line IV—IV of FIG. 1 on an enlarged scale.

The apparatus according to FIG. 1 consists substantially of a stitching base 1 and a needle board 2 which is disposed opposite of the stitching base 1, which board is inserted in the conventional manner in a needle beam 3 and can be driven in a reciprocating manner in the penetration direction of the needles 5 by means of a push rod 4. In contrast to conventional stitching bases, the stitching base in accordance with the invention forms parallel guide grooves 6 for the yarns 7 to be needled which are held under tensile stress between a roller draw-in 8 and a roller pull-off 9. For the purpose of guiding the yarns which are unwound from the supply coils, guide eyes 10 are diposed on the inlet side of the roller draw-in 8. A similar set of guide eyes 10 is disposed between the stitching base 1 and the roller pull-off 9. As is shown in FIG. 4, the individual pass-through openings 11 of the guide eyes 10 are arranged in a division according to the guide grooves 6 in the stitching base 1, thus producing a secure guidance of the yarns 7 in the direction of the yarn passage 12.

According to FIG. 1, the stitching base 1 is provided in the direction of the yarn passage 12 with a convexly arched arrangement, which leads to the force components perpendicular to the stitching base 1 in connection with the tensile stresses applied on yarns 7 by way of the roller draw-in 8 and the roller pull-off 9. The yarns 7 are therefore pulled into the guide grooves 6 by way of said resulting forces and pressed against the stitching base so that the needles 5 of needle board 2 which penetrate the yarns 7 can be pulled out of the yarns 7 again without having to fear any entrainment of the yarns 7. It is therefore possible to omit separate strippers between the needle board 2 and the stitching base 1. The stitching base 1 is provided with respective pass-through openings 13 for the needles 5. The arrangement according to the illustrated embodiment was made in such a way that the pass-through openings 13 are aligned in a straight line in the longitudinal direction of the guide grooves 6 according to the corresponding needle arrangement. Such an alignment of the needles and holes is not mandatory. In order to increase the needling effect it would be possible to provide a slight offset of the needles 5 and the pass-through holes 13 transversally to the longitudinal direction of the guide grooves 6.

As a result of the needling of the yarns 7 transversally to the longitudinal direction of the yarns, the twisting of the yarns 7 is fixed, namely over the entire needled yarn length, so that the yarns 7 can subsequently easily be cut into pieces without any likelihood of them becoming frayed from the cut ends when said cut yarn pieces are used as trimmings for a mop. Since the yarn needling can be performed continuously, the needling of the yarns 7 can be performed within the course of a production line for mop trimmings. It is naturally also possible to wind up the needled yarns again in order to store them intermediately prior to further processing.

The invention claimed is:

1. A method of producing mop trimmings from individual and separate cut pieces of twisted yarn, comprising the steps of needling straight lengths of the individual and separate twisted yarns along the entire length thereof, and cutting said straight lengths of needled twisted yarns into individual and separate pieces after the straight lengths of yarns have been needled.

* * * * *